United States Patent [19]

Carlson

[11] 4,359,063

[45] Nov. 16, 1982

[54] SPRING-BIASED FLUSHING ACCESSORY FOR OUTBOARD MOTORS

[76] Inventor: Gordon R. Carlson, 10815 Sagetrail, Houston, Tex. 77089

[21] Appl. No.: 232,153

[22] Filed: Feb. 6, 1981

[51] Int. Cl.[3] ..... B08B 9/00

[52] U.S. Cl. ..... 134/167 R; 134/169 A; 134/199; 285/9 R; 440/900

[58] Field of Search ..... 440/80, 113, 900; 134/166 R, 167 R, 168 R, 169 A, 172, 199; 285/9 R

[56] References Cited

U.S. PATENT DOCUMENTS

| | | | |
|---|---|---|---|
| 3,931,828 | 1/1976 | Lawler | 134/199 X |
| 4,121,948 | 10/1978 | Guhlin | 134/167 R X |
| 4,219,367 | 8/1980 | Cary, Jr. et al. | 134/199 X |

FOREIGN PATENT DOCUMENTS

| | | | |
|---|---|---|---|
| 527304 | 6/1931 | Fed. Rep. of Germany | 134/167 R |
| 44-10636 | 12/1969 | Japan | 134/199 |

*Primary Examiner*—Robert L. Bleutge
*Attorney, Agent, or Firm*—Martha G. Pugh

[57] ABSTRACT

A self-gripping spring-biased accessory for directing water from an outside source to flush out the cooling system of a marine engine. The accessory comprises a U-shaped retainer terminating at its upper ends in a pair of resilient suction cups which are constructed to bear against the cooling water intake ports on opposite walls of the engine housing. At least one of the cups is connected to an external source of flushing water. A particular feature of the invention, disclosed in several different embodiments of the invention, is that the U-shaped retainer is provided with an auxiliary device to impart a spring-bias to the legs, urging them to move towards one another to secure the suction cups in resilient sealed relation against the cooling water intake ports. In a further modification, a device is provided to apply the flushing water simultaneously to intake ports on opposite walls of the engine housing.

7 Claims, 12 Drawing Figures

SPRING-BIASED FLUSHING ACCESSORY FOR OUTBOARD MOTORS

BACKGROUND OF THE INVENTION

This relates in general to spring-biased attachments for marine motors, and methods of using the same.

It is well-known that when outboard or stern-drive motors are removed from the water for transportation or storage purposes, it is necessary to flush them out to remove debris such as sand, silt, mud or alkalis, which has accumulated from their use, and all traces of salt water which tends to have a corrosive effect on the engine parts.

Several types of systems for accomplishing this purpose have been developed in the prior art. These include systems employing various types of mechanical coupling devices, such as disclosed in W. R. O'Hara U.S. Pat. No. 2,005,385, issued June 18, 1935; F. M. Houchin, U.S. Pat. No. 2,644,474, issued July 7, 1953; K. G. Guhlin U.S. Pat. No. 3,002,488, issued Oct. 3, 1961. Other prior art patents disclose systems which include portable cleaning containers such as, H. E. Crozier, U.S. Pat. No. 3,003,456, issued Oct. 10, 1961; J. E. Kiefer U.S. Pat. No. 2,620,812, issued Dec. 9, 1952; and A. J. Burger, U.S. Pat. No. 3,886,889, issued June 3, 1975.

Still other prior art patents disclose various types of straps and belts for applying the hose outlet to the motor housing intake ports. These include O. B. Bensen U.S. Pat. No. 2,611,631, issued Sept. 23, 1952; R. A. Patel, U.S. Pat. No. 4,052,953, issued Oct. 11, 1977; and my earlier U.S. Pat. No. 4,108,190, issued Aug. 22, 1978. None of the foregoing provides a fully satisfactory system for flushing out marine engines.

Accordingly, it is the broad object of this invention to provide an improved attachment and method for flushing outboard or stern-drive motors. A more specific object of the invention is to provide a flushing attachment which can be quickly and easily snapped into place against the water intake ports on opposite sides of the motor housing, which provides a snug, resilient coupling which retains its shape after repeated use, and may be simply and economically manufactured.

Another object of the invention is to speed up the flushing operation by enabling the equipment to handle a larger volume of flushing water than possible with prior art equipment.

These and other objects are realized in accordance with the present invention in a flushing apparatus comprising a pair of resilient suction cups adapted to be maintained in fluid-communicating relation with water intake ports on opposite sides of the motor housing by attachment to opposite ends of a U-shaped retainer rod which is spring-biased to urge the cups toward one another. In one embodiment, the bias is created by a separate coil-spring connected between the two arms at the lower end of the U-shaped retainer rod. In a second embodiment, a single coil is integrally formed into the nadir of the U-shaped rod. In a third embodiment, the single coil is replaced by a pair of loupes formed in opposite arms of the U-shaped retainer rod. In a fourth embodiment, the opposite arms of the U-shaped construction are separately molded of rigid plastic material, for example; and the lower ends are snapped together in a concentric hub relation, being biased against outward rotation by the prongs at opposite ends of a torsion spring. In still another embodiment, which is a variation of the U-shaped retainer rod formed with a single coil in the nadir, a Y-shaped hose connection enables flushing water to be transmitted from a faucet or other source to the resilient cups on opposite sides simultaneously.

Particular advantages of the flushing device of the present invention are that it maintains the resilient suction cups closely coupled to the intake ports on opposite sides of the motor housing; and the U-shaped retainer rod does not readily relax its grip after multiple uses. The device is easily and inexpensively manufactured and is readily installed on the motor housing. For example, the embodiment comprising separate arms is adapted so that the hub portions snap together and the arms are biased toward one another by a torsion spring enclosed in the hub, which may be formed of molded plastic. Further, the embodiment having the Y input connection for simultaneously servicing water input couplings at ports on opposite sides of the motor housing is adapted for use by dealers and mechanics servicing engines operating at 1200 or more revolutions per minute, and requiring large quantities of flushing water. A particular feature of this embodiment is that because the volume of water passing into each input arm of the Y connection is divided in half, a smaller stream passes in through each individual suction cup. If a stream of double volume were to be forced into a cup on one side only, it would have the tendency to pass through the motor housing and force the cup at the opposite side away from the housing wall, thus causing an excessive loss of flushing water, causing the engine to run hot. This is avoided when two smaller streams are interposed into the cups on opposite sides through the Y hose connection.

These, and other objects, features and advantages will be better understood from a detailed study of the invention with reference to the attached drawings.

SHORT DESCRIPTION OF THE DRAWINGS

Figure 4A:
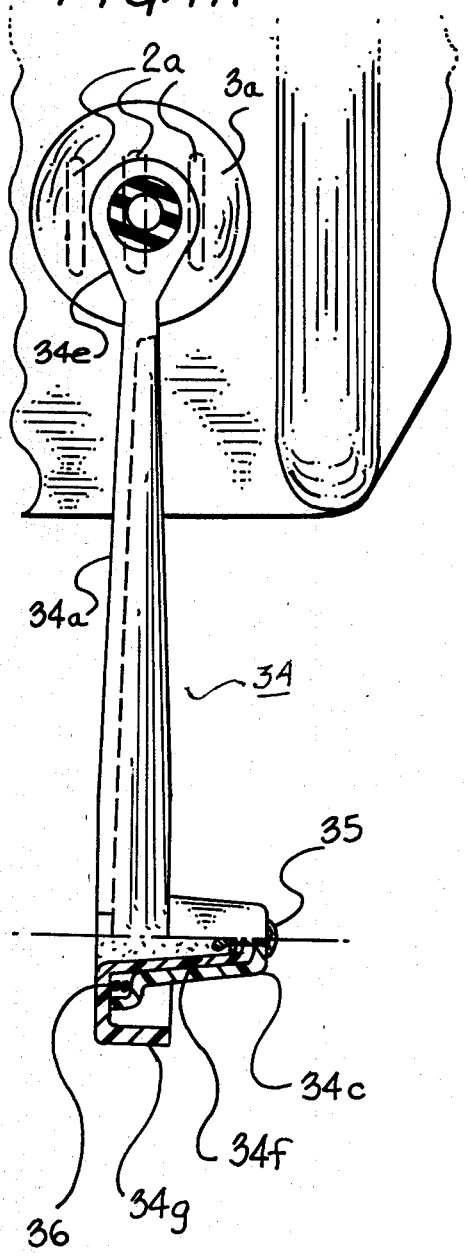
Figure 4B:
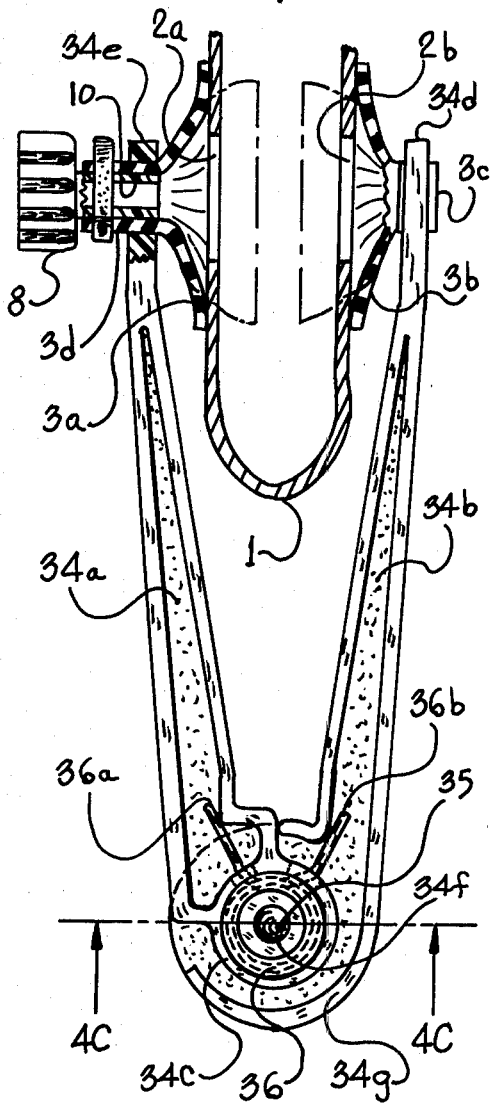
Figure 4C:
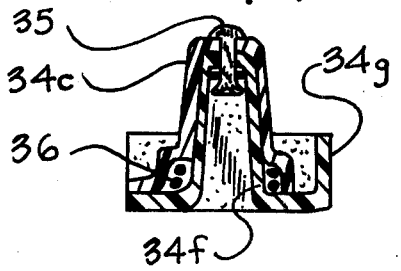

FIGS. 4A and 4B show in front and side elevation, respectively, a further modification of the invention in which the U-shaped retainer device comprises a pair of separately formed arms of semi-rigid plastic, in which the ends opposite to the resilient cups are fitted together in concentric relation to form a hub, the arms being biased to move toward one another by a torsion spring mounted in the hub. FIG. 4C is a detailed sectional showing of the hub of FIGS. 4A, 4B.

Figure 5A:
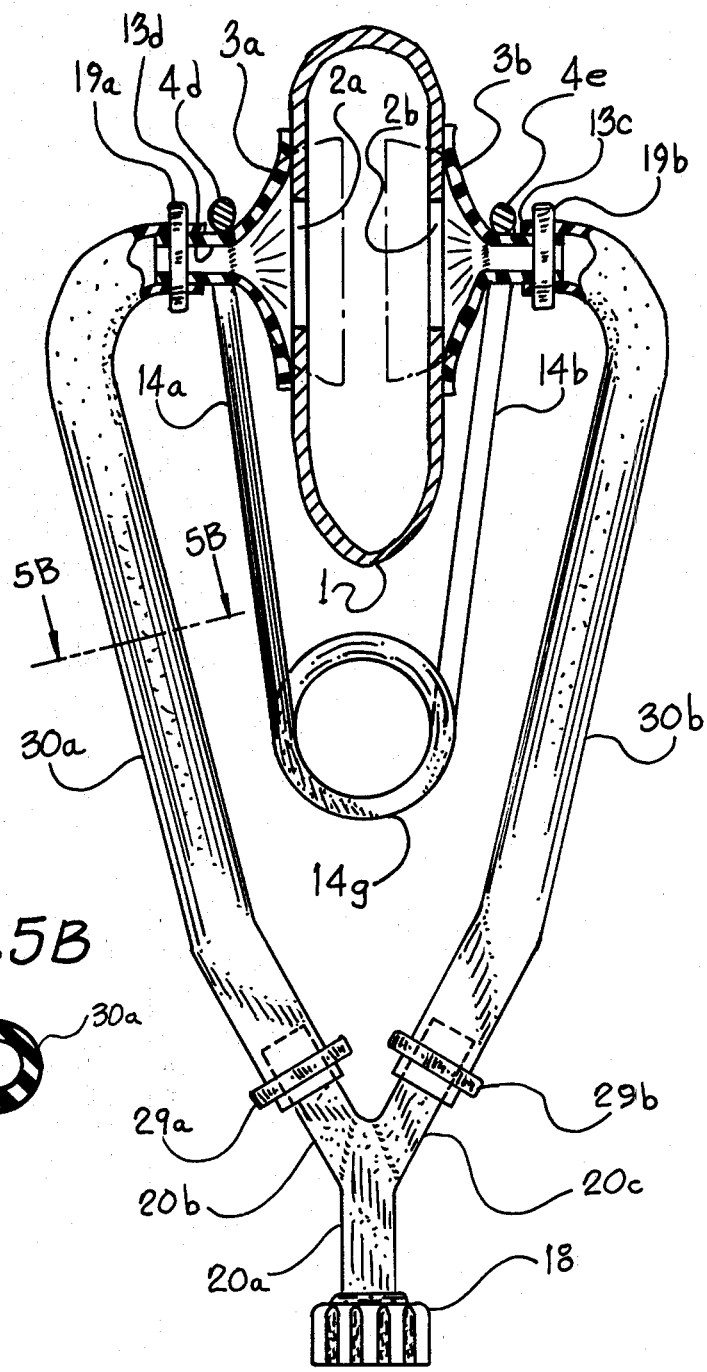
Figure 5B:
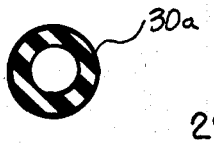

FIG. 5A is a further modification of the invention in which the water input hose is connected through a Y connection simultaneously to intake ports on both sides of the motor housing. FIG. 5B is a cross-section through one of the hoses of FIG. 5A.

DETAILED DESCRIPTION OF THE INVENTION

Figure 1A:
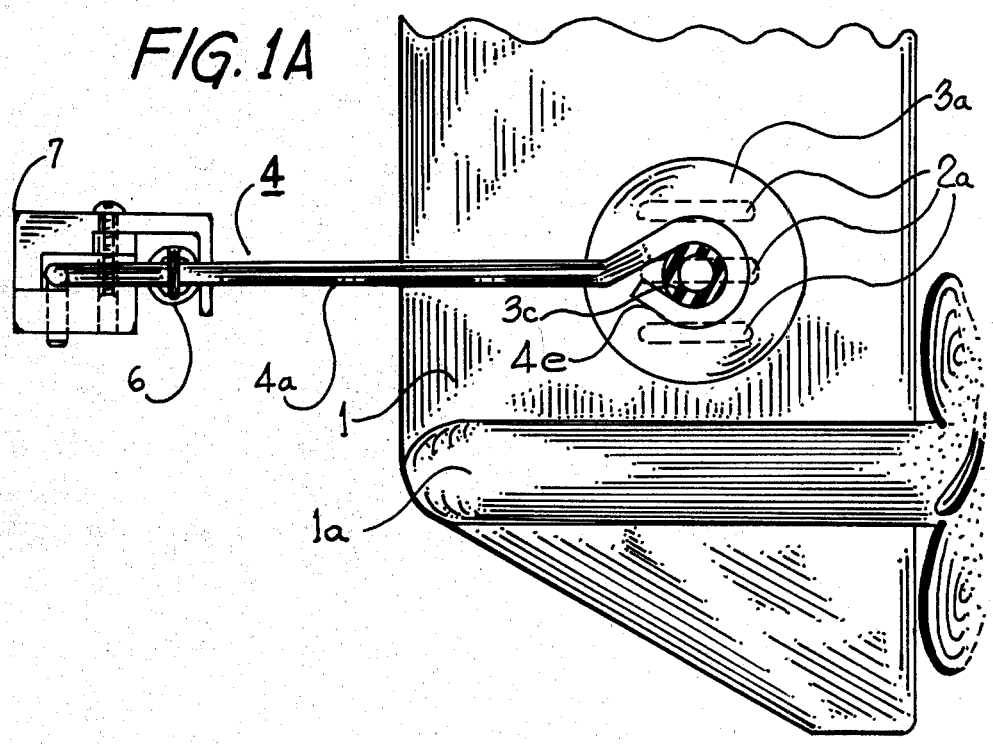
FIG. 1A shows in front elevation one embodiment of a flushing apparatus of the present invention which comprises a pair of resilient cups held in place against cooling water intake ports on opposite sides of a marine motor housing by the free ends of a U-shaped retainer rod which is spring-biased by a coil-spring interposed between its legs.
Figure 1B:
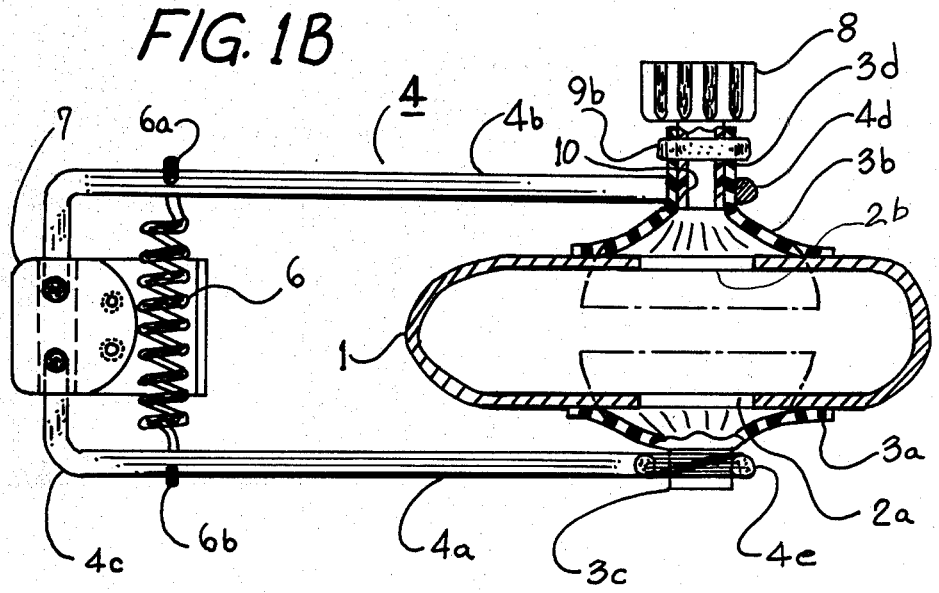
FIG. 1B shows the embodiment of the apparatus of FIG. 1A with the lateral portions in side elevation, and the central portion in contact with the motor housing, in section.

Referring to FIGS. 1A and 1B of the drawings, 1 indicates the lower motor housing of a typical outboard or stern-drive motor, having two sets of interconnected water intake ports 2*a* and 2*b*, each comprising, for example, three elongated elliptical intake ports. The two sets of intake ports 2*a* and 2*b* are spaced apart, preferably on opposite sides of housing 1.

A pair of frusto-conical suction cups 3*a*, 3*b* is designed to be superposed in contact with the lower motor housing wall 1, so as to cover each of the sets of intake ports 2*a*, 2*b*. In a preferred embodiment, the suction cups 3*a*, 3*b* are formed of any elastomer or flexible material, such as, for example, natural rubber, or synthetic rubber, known as neoprene, or other plastic material such as polyethylene. In the present illustrative embodiment, the cups 3*a*, 3*b* are of neoprene, having an overall diameter of 3½ inches, a wall thickness of, say, 3/16 inch, and a depth of ¾ inch on the internal central portion. A coupling pipe 3*d* of circular cross-section, say, ½ inch in internal diameter, and ⅝ inch in outer diameter protrudes outwardly 1 inch from the center of the flexible cup 3*b*, coaxially accommodating the coupling pipe 10 protruding from the conventional hose coupling 8. Pipe 3*d* is held in place on pipe 10 by a hose clamp 9*b*. Pipe 3*c* on the other cup extends an axial distance of 1 inch in the opposite direction, and may be closed at its outer end.

An important feature of the present invention is that a retainer 4, which may be formed, for example, of a rod of stainless steel, or any similar rigid metal, 5/16 inch in diameter, is bent into a U-shaped retainer rod, roughly 10 inches long, in an axial direction, from the closed to open ends, the latter terminating in a pair of eyelets 4*d* and 4*e*, which are respectively mounted to surround pipes 3*c* and 3*d* externally, in such a manner that they each bear against the central portions of the cups 3*a* and 3*b* tending to compress and flatten the cups against the outer surface of housing 1 to substantially enclose the area surrounding the water intake ports 2*a* and 2*b*.

Transversely mounted near the closed end of the U-shaped retainer 4, is a coil spring 6. In the present example, the coil spring 6 is formed of a metal rod approximately ⅛ inch in cross-section, which is wound into 12 turns, to produce a coil having an overall diameter of about ⅝ inch. The terminals 6*a* and 6*b* are bolted or otherwise secured in openings drilled through the thickness of the rod 4 in diametrically opposite positions. A spring housing 7, which may comprise, for example, a substantially rectangular sheet of stainless steel, or the like, is bolted or otherwise rigidly fastened along one edge to the closed end of the U-shaped retainer 4 to form an enclosure which partially encloses, but is not contiguous with spring 6. The latter provides a spring-bias between the arms 4*a* and 4*b*, which tends to urge the cups 3*a* and 3*b* towards one another, and into substantially snug elastic contact against the wall of housing 1, covering the intake ports 2*a* and 2*b*. Alternatively, housing 7 may be plastic.

Figure 2A:
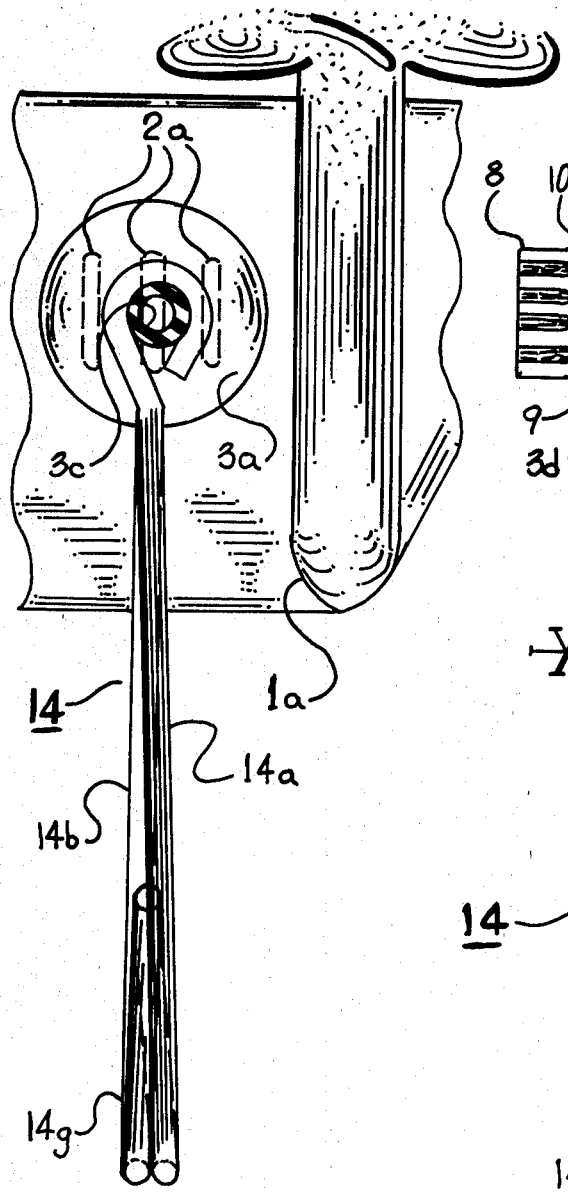
FIGS. 2A and 2B show in front and side elevations, respectively, a modification of the embodiment of FIGS. 1A, 1B, in which the coil-spring-biasing means is replaced by a single coil formed integrally into the closed end-portion of the U-shaped retainer rod.
Figure 2B:
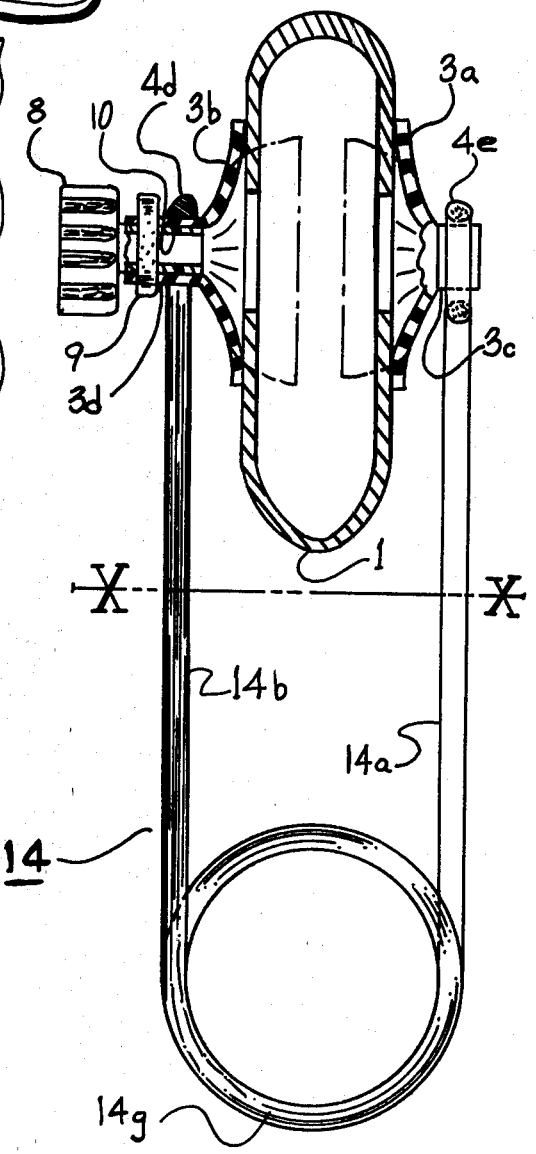

One modification of the device of the present invention is disclosed in FIGS. 2A and 2B, in which the like numbered portions of the gripping head, including the cups 3*a* and 3*b* and the hose coupling 8, are substantially the same as the elements described with reference to FIGS. 1A, 1B. In the device of FIGS. 2A, 2B, the U-shaped retainer 4 of FIGS. 1A, 1B is replaced by the retainer 14. This comprises a metal rod of cold rolled steel or the like, 5/16 inch in cross-section, which is formed to include in the bent-portion at its closed end, a single turn 14*g*. This turn may, for example, be 3 inches in overall diameter. This provides spring action which imposes a spring-bias between the arms 14*a* and 14*b* tending to force the cups 3*a* and 3*b* towards one another, as in FIGS. 1A, 1B.

Figures 3A, 3B, 3C:
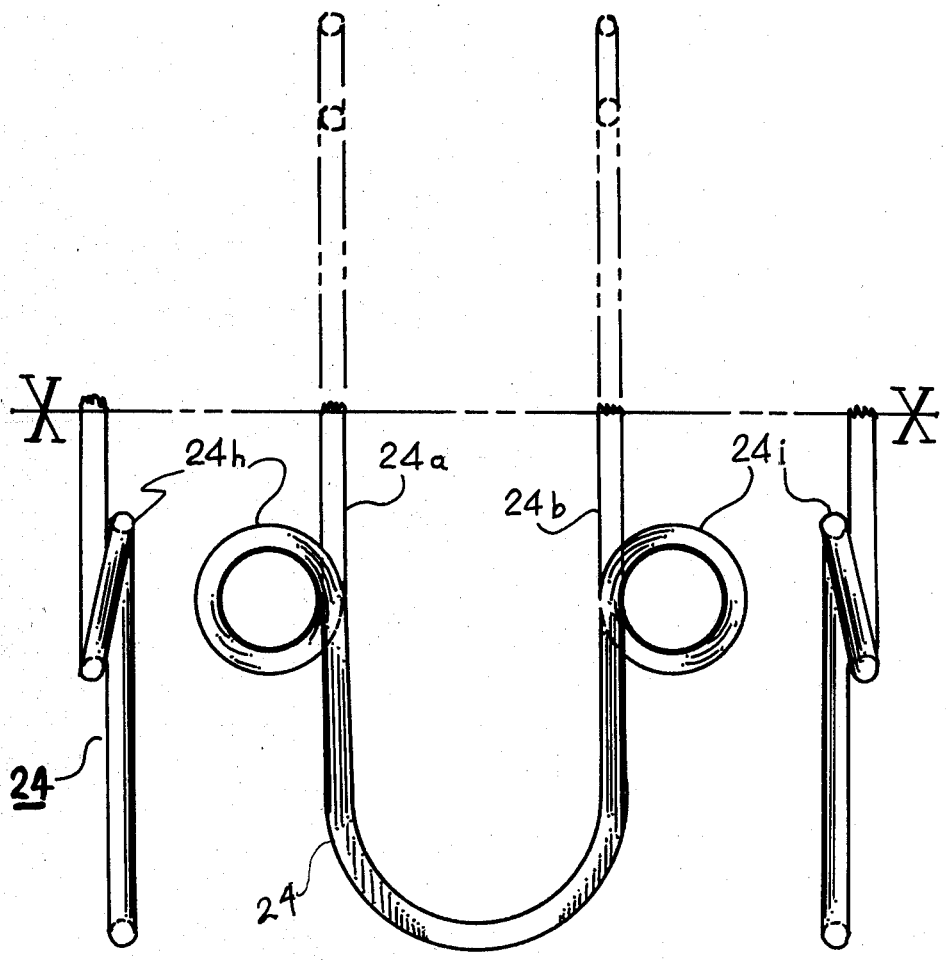
FIGS. 3A, 3B and 3C show in side, front and rear elevation, respectively, another modification of the invention in which the single-coil of FIGS. 2A, 2B is replaced by a pair of coils interposed into opposite side arms of the U-shaped retainer rod.

Another modification of the invention is indicated in FIGS. 3A, 3B and 3C of which the portion of the device in the plane above the line X—X is substantially similar in form to the devices described in the previous figures. The U-shaped retainer 24, which is substituted for the retainers 4 and 14 of the previous figures, comprises a rod of the same material and cross-sectional dimension as in the previous figures, which is formed to include at diametrically opposite positions on each of its legs 24*a* and 24*b*, a pair of single turns 24*h* and 24*i*. These may, for example, be 1¼ inches in outer diameter. The turns 24*h* and 24*i* provide the same spring action between the legs as is provided by the coil spring 6 of FIGS. 1A and 1B, and as is provided by the single turn 14*g* of FIGS. 2A, 2B.

Another modification of the invention is shown in FIGS. 4A, 4B and 4C, in which the two-part moulded plastic retainer 34 replaces the U-shaped retainer 4 of FIGS. 1A, 1B.

The two part retainer 34 is moulded out of a rigid plastic, such as, for example, an acetate copolymer manufactured and sold by the Celanese Plastics Company under the trademark "CELCON", or alternatively, by E. I. DuPont de Neymours Company, under the trademark "DELRIN". Each of the component arms 34*a* and 34*b* is manufactured to include an eyelet, 34*d* and 34*e* at its upper end, which fits over a respective one of the pipes 3*c* and 3*d*. The arm 34*b* broadens out at its lower end to form a hub having a hollow inner axial member 34*f* which extends in a direction normal to the principal plane defined by the arms 34*a* and 34*b*, and an externally connected member 34*g* which partially surrounds 34*f* in a coaxial configuration. The other arm 34*a* broadens at its lower end to form a hollow cylindrical fitting 34*c* which snap-fits between the inner axial member 34*f* and the coaxial outer member 34*g*. Between 34*c* and the base of 34*f* is mounted a torsion spring 36, which is wound around the axial member 34*f*, and has two projecting ends 36*a* and 36*b* which are respectively disposed to bear on projecting shoulders of arms 34*a* and 34*b*, thereby imposing a spring-bias between them which tends to urge the cups 3*a* and 3*b* towards one another. Pin 35 holds 34*c* and 34*f* together.

Another modification of the invention is shown in FIG. 5A which is adapted for use in connection with large marine motors requiring a large flow of flushing water. Instead of having the water source hose connection to one side only, in the manner indicated in the previous figures, the device of FIG. 5A is adapted to accommodate hose connections to both of the cups 3*a* and 3*b* simultaneously, thus doubling the flushing water input to the marine engine. In FIG. 5A, the elements bearing the same numbers to those of FIGS. 2A, 2B are substantially similar to like-numbered elements described with reference to FIGS. 2A, 2B and will not be redescribed. The coupling pipes 13*c* and 13*d* protrude 1⅛ inches out from the center of each of the cups 3*a* and 3*b*. Coupling pipes 13*c* and 13*d* are ½ inch in inner diameter and ⅝ inch in outer diameter. The arms 14*a* and 14*b* are respectively mounted on the coupling pipes 13*d* and 13*c* by means of the eyelets 14*d* and 14*e*, so that spring-bias is exerted against the cups 3*a* and 3*b* as in FIGS. 2A, 2B.

A hose coupling 18 is provided for coupling the device to a water source. This has a Y fitting with a single pipe 20*a* which leads into a pair of pipes 20*b* and 20*c*. A pair of hose members 30*a* and 30*b*, of natural rubber or artificial rubber, such as neoprene, or other plastic are each 12 inches long, and has an inner diameter of ⅝ inch, and an outer diameter of 1 inch.

The hose 30*a* extends between the Y pipe arm 20*b*, where it is held in place by pipe clamp 29*a*, to the coupling pipe 13*d*, where it is held in place by pipe clamp 19*a*. Likewise, hose 30*b* extends between the other Y pipe arm 20*c*, where it is held in place by hose clamp 29*b* to the coupling arm 13*c*, where it is held in place by hose clamp 19*b*. Thus, water from a single source is divided into two streams passing through the arms 20*b* and 20*c* of the Y coupling, and is injected simultaneously into each of the sets of intake ports 2*a* and 2*b* on opposite sides of motor housing 1.

The present invention is not limited to the specific configurations described herein by way of example, but only by the scope of the appended claims.

What is claimed is:

1. A flushing system for outboard and stern-drive motors having an external motor housing which includes at least two water intake ports substantially spaced apart on opposite sides of said housing, said system comprising:

a pair of resilient sealing devices of material substantially impervious to water;

a U-shaped retainer having the free ends of its two legs comprising means respectively constructed and arranged to support and maintain said resilient sealing devices in substantially water-tight gripping relation against the respective outer faces of said housing in positions respectively disposed to substantially enclose the areas including said spaced apart water intake ports;

said U-shaped body being constructed and arranged to straddle said external motor housing between said spaced apart water intake ports;

at least one of said resilient sealing means being provided with a water-flow passage connectable to a source of water; and means auxilliary to said U-shaped retainer for imposing a spring-bias between the legs of said U-shaped retainer whereby the opposite inner faces of said resilient sealing means tend to be urged toward one another against the force of said spring-bias.

2. A flushing system for outboard and stern-drive motors in accordance with claim 1 wherein said means for imposing a spring-bias between the legs of said U-shaped retainer comprises a separate coil-spring connected from one to the other of said legs.

3. A flushing system for outboard and stern-drive motors in accordance with claim 1 wherein said U-shaped retainer comprises a bent metal rod and said means for imposing a spring-bias between the legs of said U-shaped retainer comprises at least one coil formed integrally into said U-shaped rod.

4. A flushing system for outboard and stern-drive motors in accordance with claim 3 wherein said at least one coil comprises a single turn formed integrally into the closed end of said U-shaped rod.

5. A flushing system for outboard and stern-drive motors in accordance with claim 3 wherein said at least one coil comprises a single turn formed integrally into each of the opposite legs of said U-shaped rod.

6. A flushing system for outboard and stern-drive motors in accordance with claim 1 wherein said U-shaped retainer is formed from a pair of separately constructed arms consisting essentially of plastic, and seperably snapped together in a hub-like junction to form said U-shaped retainer, and wherein said spring-biasing means comprises a coil-spring interposed into said hub-like junction, so as to bear at its opposite ends against opposite ones of said arms, tending to hold said arms together against the compression of said spring, thereby tending to urge said resilient sealing devices towards each other.

7. A flushing system for outboard and stern-drive motors in accordance with claim 1 wherein said water-flow passage connectable to a source of water includes a Y connection having a pair of arms, one of said arms being simultaneously connected through a water hose to each of said resilient sealing means simultaneously, whereby flushing water is enabled to flow into the intake ports on both sides of said housing simultaneously.

* * * * *